United States Patent [19]

Terzian

[11] 4,158,931

[45] Jun. 26, 1979

[54] ANIMATED ACTION TOY

[75] Inventor: Rouben T. Terzian, Chicago, Ill.

[73] Assignee: Marvin Glass & Associates, Chicago, Ill.

[21] Appl. No.: 876,404

[22] Filed: Feb. 10, 1978

[51] Int. Cl.[2] ..... A63H 5/00; A63H 13/00

[52] U.S. Cl. ..... 46/118; 46/44; 46/232

[58] Field of Search ..... 46/118, 117, 232, 163, 46/171, 44, 135 R

[56] References Cited

U.S. PATENT DOCUMENTS

| | | | |
|---|---|---|---|
| 2,942,380 | 6/1960 | Coulter | 46/232 |
| 3,153,881 | 10/1964 | Baulard-Cogan | 46/163 X |
| 3,702,515 | 11/1972 | Beasley et al. | 46/232 |
| 3,757,463 | 9/1973 | Breslow et al. | 46/118 |
| 3,793,766 | 2/1974 | Moquin et al. | 46/117 |
| 4,124,952 | 11/1978 | Terzian | 46/44 |

FOREIGN PATENT DOCUMENTS

| | | | |
|---|---|---|---|
| 24391 of | 1895 | United Kingdom | 46/118 |

*Primary Examiner*—John F. Pitrelli

*Attorney, Agent, or Firm*—Mason, Kolehmainen, Rathburn & Wyss

[57] ABSTRACT

An animated action toy for young children and the like includes a doll having a hollow body with a head having a face with a mouth and movable lips. An air bladder is mounted in the doll's body and is interconnected to move the lips in response to changes in volume. In addition, an electrical speaker is carried in the body of the doll to provide sound animation. The doll is associated with a remote telephone handset which includes a microphone and a handle portion which includes a lever for activating a fluid pump. An elongated flexible connector is provided between the doll and the handset and a pneumatic tube is included in the connector for communication between the pump and the air bladder with an electrical cord provided for interconnecting the microphone in the handset and the speaker in the doll's body.

During play, the handset is held in the hand like a telephone while speaking into the microphone and actuating the hand pump. This results in moving the lips of the remote doll as the sound animation is provided by the speaker in the doll's body.

12 Claims, 5 Drawing Figures

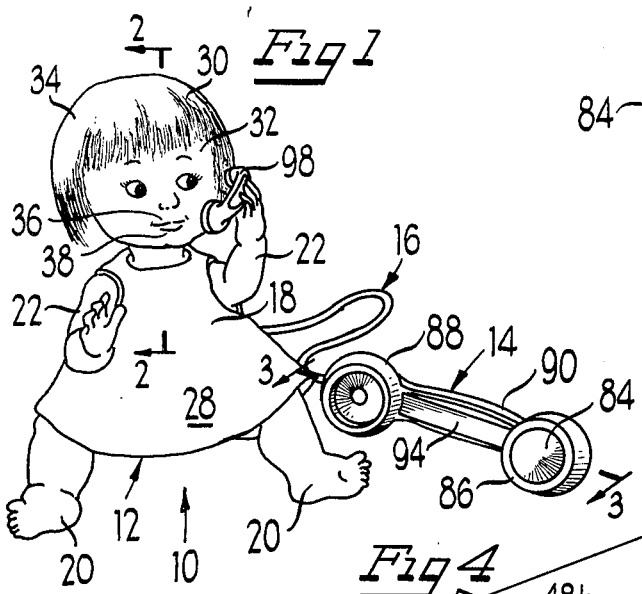
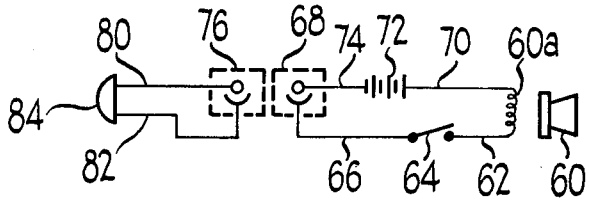
Fig 5
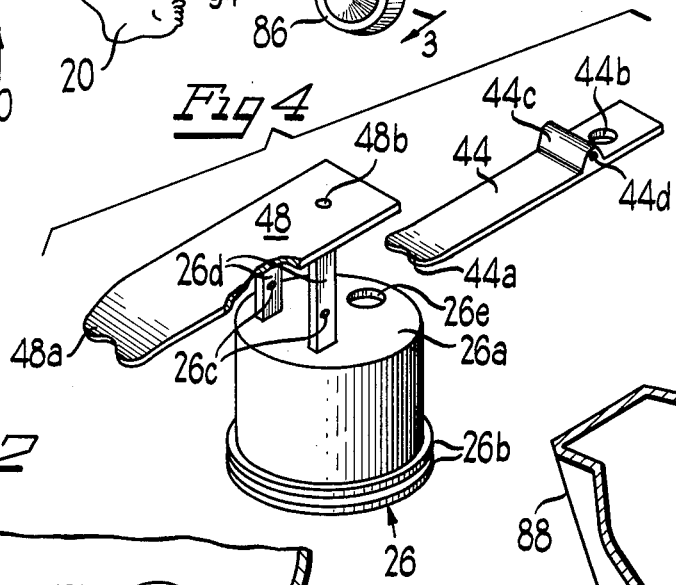
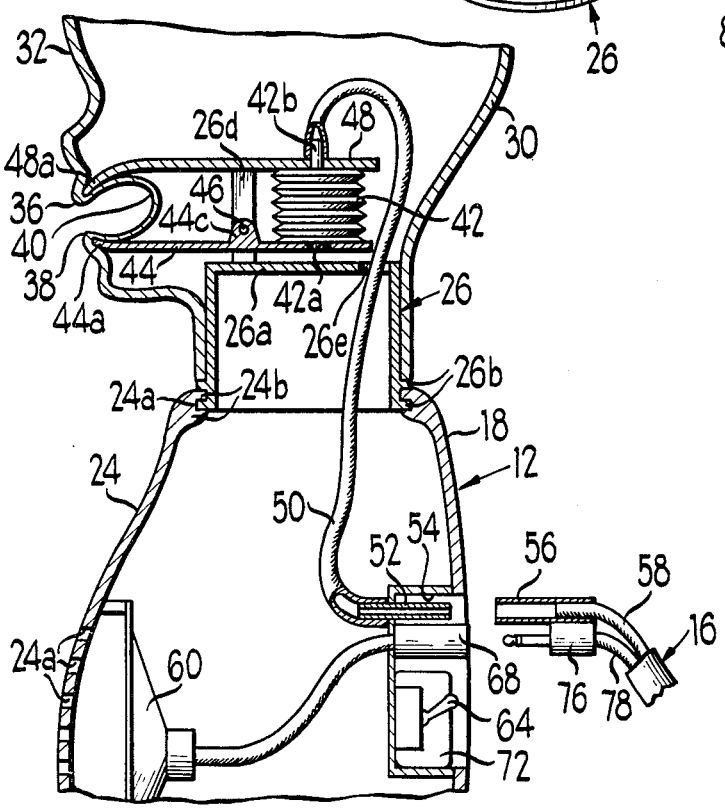
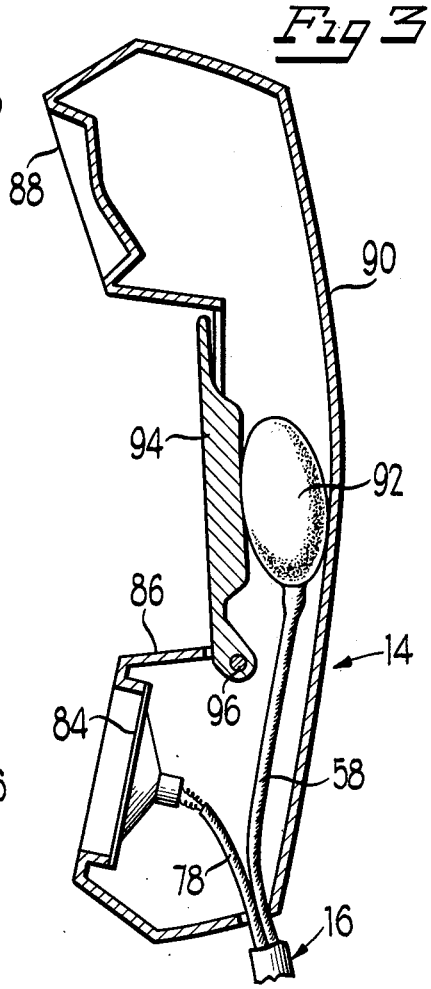

ANIMATED ACTION TOY

BACKGROUND OF THE INVENTION

1. Field of the Invention

The present invention relates to a new and improved animated action toy for young children and the like. More particularly, the invention relates to a talking telephone doll wherein a remote telephone handset is provided in combination with a doll and the handset includes a fluid pump and microphone adapted to be interconnected through an elongated flexible connector to the body of the doll which has movable lips that appear to talk as animated sound is provided from an internal speaker therein.

2. Description of the Prior Art

Various types of crying and talking dolls have been developed and a variety of telephone type toys have also been provided over the years. As far as is known, however, an animated action toy including a talking doll with movable lips and a sound speaker in the body in combination with a remote telephone handset having a microphone and pump for moving the lips of the doll during animated talk have not been successfully developed.

BRIEF SUMMARY OF THE INVENTION

It is an object of the present invention to provide a new and improved animated action toy for young children and the like.

More particularly, it is an object of the invention to provide an animated talking doll with movable lips and a sound source therein which is activated by a remote telephone handset having a microphone and fluid pump therein for making the doll's lips move as the animated sound is generated and reproduced in the speaker of the doll's body.

It is another object of the present invention to provide a new and improved animated toy of the character described wherein an elongated, flexible connector is provided between the doll and the telephone handset having detachable connectors so that the doll may also be utilized without the handset or attaching connector when desired.

Yet another object of the present invention is to provide a new and improved animated talking doll of the character described which is realistic in appearance, fun to play with and which can be manufactured on an economical basis.

Still another object of the present invention is to provide a new and improved animated action toy of the character described wherein a novel system is provided for moving the lips of the doll to simulate talking in combination with animated sound emanating from the body of the doll.

The foregoing and other objects and advantages of the present invention are accomplished in an illustrated embodiment by way of example and not limitation which includes an animated action toy comprising a doll having a hollow body with a head and face of flexible skin. A mouth defined by at least one movable lip is provided on the doll's face and a variable volume fluid chamber or air bladder is mounted in the body and interconnected to move the doll's lip in response to changes in volume. An electrically actuated sound speaker is mounted in the body to provide animated sound to be accompanied by lip movement. A telephone type handset remote from the doll includes a microphone and a handle portion for actuating a variable volume fluid pump. The handset and doll are detachably interconnected by means of an elongated flexible connector having a fluid conduit with a flexible portion for providing fluid connection between the air bladder in the doll's body and the pump in the handset. Additionally, the connector includes an electrical cord with a flexible portion for electrically interconnecting the speaker in the doll with the microphone in the handset. The elongated connector is detachably connected to the doll so that the doll may be utilized for play without the animated features when desired.

BRIEF DESCRIPTION OF THE DRAWINGS

For a better understanding of the invention, reference should be had to the following detailed description taken in conjunction with the drawings, in which:

FIG. 1 is a front, perspective elevational view of a new and improved animated action toy apparatus constructed in accordance with the features of the present invention;

FIG. 2 is a longitudinal, fragmentary, vertical, sectional view taken substantially along lines 2—2 of FIG. 1;

FIG. 3 is a longitudinal, sectional view of the remote handset taken substantially along lines 3—3 of FIG. 1;

FIG. 4 is an exploded, perspective view of a lip moving apparatus in accordance with the features of the present invention; and FIG. 5 is a schematic, electrical diagram of the sound system in accordance with the invention.

DESCRIPTION OF THE PREFERRED EMBODIMENT

Referring now more particularly to the drawings, in FIG. 1 is illustrated a new and improved animated action toy constructed in accordance with the features of the present invention and referred to generally by the reference numeral 10. The action toy includes a doll 12 in combination with a remote telephone handset 14 and the doll and handset are interconnected by a flexible, elongated, connector 16 which is detachable from the body of the doll when desired.

The doll 12 includes a hollow lower body portion 18 preferably formed of flexible molded plastic material and including a pair of legs 20 and a pair of arms 22 on a torso or main body portion 24. At the upper end of the doll body there is provided a circular opening *24a* (FIG. 2) in order to accommodate an upstanding inner neck 26 of generally cylindrical shape formed with an upper end wall *26a* and having a pair of annular ridges *26b* adjacent the lower end adapted to interfit with a pair of annular ribs *24b* on the body 24 of the doll around the opening *24a*. The doll is provided with clothing 28 and a hollow head 30 is mounted for rotating movement on the upstanding cylindrical hollow neck portion 26 which preferably is formed of relatively rigid molded plastic material. The hollow head 30 includes a face 32 on the front side and a head of hair 34 on the top side and back and sides of the face. Preferably, the head of the doll is also formed of molded, flexible plastic material. The face is shaped to include a pair of relatively movable upper and lower lips 36 and 38, respectively, separated by an indented or recess mouth 40 formed in a continuous wall between the lips. Because the face 32 is formed of thin flexible plastic material, the lips 36 and 38 are readably movable toward and away from each other as the mouth 40 appears to open and close, as if the doll was talking or making sounds.

In accordance with the features of the present invention, the doll 12 includes an internally mounted air bladder or bellows type fluid chamber 42 closed at its lower end and seated on the upper surface of a lip moving lever 44 having a forward end 44*a* engaging the inside wall surface of the lower lip 38 as shown in FIG. 2. The lip moving lever is provided with a circular opening 44*b* in which is seated an integral boss 42*a* provided on the lower end wall of the air bladder fluid chamber to center the same on the lever. Intermediate the ends, the lever 44 is provided with an integral transverse rib 44*c* having an opening or bore 44*d* adapted to accommodate a supporting axle 46 for pivotally supporting the lever inside the doll's head. The axle is transverse to the lever and is mounted at its opposite outer ends in openings 26*c* provided in a pair of spaced apart, upstanding legs 26*d* integrally formed on the upper end wall 26*a* of the inner neck portion 26. Integrally attached to the upper ends of the legs is provided a fixed upper lip engaging member 48 having an outer end 48*a* adapted to engage the inside head surface of the upper lip 36 as shown in FIG. 2. Adjacent a rearward or inner end portion of the member 48, there is provided an opening 48*b* in which is seated an upstanding, hollow inlet tube 42*b* on the bellows 42 adapted to direct air to flow into and out of the expansible bellows. As the bellows expands and contracts, the lower lip lever 44 pivots on the pivot axle 46 relative to the member 48 and moves the lower lip 38 toward and away from the upper lip 36 to simulate the appearance of talking on the face of the doll.

The inlet tube 42*b* of the air bladder or bellows 42 is interconnected to an end of the flexible connector 16 by means of an air tube 50 internally of the doll 12 which extends downwardly from the hollow head 30 through an opening 26*e* in the upper wall 26*a* of the inside neck into the troso 24. At the lower end, the air tube is connected to a rigid hollow connector sleeve 52 which extends outwardly from an inside wall of a connector compartment 54 formed adjacent a back wall of the body 24 of the doll. The fixed connector sleeve 52 is adapted to be telescopically engaged within a larger diameter, hollow connector sleeve 56 provided on one end of a hollow flexible fluid tube 58 of the elongated flexible connector 16. The pair of interfitting fluid connector sleeves 52 and 56 provide a detachable coupling for passing air between the internal tube 50 in the doll and the external tube 58 in the flexible connector 16 connected to the handset 14.

In accordance with the invention, the doll 12 is also provided with an electric speaker 60 for producing sound and this speaker is mounted to face outwardly towards the inside front wall of the doll's body, which front wall is provided with a plurality of sound ports 24*a* as shown in FIG. 2 in a cluster.

Referring now to the schematic diagram of FIG. 5, the speaker 60 includes a voice coil 60*a* which is interconnected via a lead 62 to one pole of an on/off switch 64 of the single pole, single throw type. The on/off switch is mounted on the rear of the doll's body and is connected via a lead 66 to one terminal of the female connector plug 68 also mounted on the rear of the doll's body adjacent the pneumatic connector sleeve 52. The other terminal of the voice coil 60*a* is interconnected via a lead 70 to one terminal of a "DC" battery 72 carried on the back of the doll's body. An opposite terminal of the battery 72 is connected via a lead 74 to the other terminal in the phone type terminal jack 68. A two terminal, male connector phone plug 76 is adapted to provide detachable electrical interconnection between the handset 14 and the doll 12 and the phone plug is mounted on the end of a two conductor electrical cord 78 of the flexible connector 16.

As shown in the schematic diagram of FIG. 5, the cord 78 includes a pair of leads 80 and 82 connected to the terminals of a carbon button type microphone 84 that is mounted in a mouth piece portion 86 of the body of the handset 14.

Referring to FIGS. 1 and 3, the handset 14 is preferably formed of hollow molded plastic material and includes an ear piece 88 at the upper end of an elongated intermediate handle portion 90. In accordance with the invention, the handle portion provides a housing for holding a flexible air bladder or fluid pump chamber 92 which is compressible and expandable to vary the volume thereof by means of a lever 94 pivotally mounted at one end on a mounting axle 96 carried in the handle. When the handset 14 is picked up and the lever is them pumped in and out with the fingers, the variable volume pump chamber 92 causes air to flow into and out of the fluid chamber 42 in the doll when the fluid tube is plugged into the doll. By synchronization of the pumping action on the lever 94 with the sound spoken into the microphone 84, the doll 12 appears to be talking on the telephone. The arms 22 and left hand of the doll is provided with a minature telephone handset 98 which may be positioned as illustrated in FIG. 1 to make the animated action toy even more realistic in appearance. When desired, the respective pairs of fluid and electrical connectors 52, 56, 68 and 76 may be disconnected and the doll 12 may be then utilized as an ordinary doll without any talking action or mouth moving features.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. An animated action toy comprising:

a doll having a hollow body with a head having a face with at least one movable lip;

variable volume fluid chamber means in said body interconnected to move said lip in response to changes in volume thereof;

electrically actuated sound speaker means in said body;

a telephone handset remote from said doll including microphone means and a handle portion with variable volume fluid pump means mounted therein for manual actuation when said handle portion is grasped; and elongated connector means including a fluid conduit with a flexible portion for providing a fluid connection between said fluid chamber means of said doll and said fluid pump means of said handset and including an electrical cord with a flexible portion for electrically interconnecting said speaker means of said doll with said microphone means of said handset.

2. The animated action toy of claim 1 wherein said elongated connector means includes a pair of detachable fluid connectors and a pair of detachable electrical connectors, one connector of each pair being mounted on said hollow body of said doll and the other connector of each pair being secured to a respective flexible portion of said connector element externally of said doll.

3. The animated action toy of claim 2 wherein said elongated connector means includes an internal segment of said fluid conduit in said hollow body between said fluid chamber means and said one fluid connector.

4. The animated action toy of claim 2 wherein said elongated connector means includes an internal electrical cord in said body between said speaker means and said one electrical connector.

5. The animated action toy of claim 4 including switch means for selectively making and breaking electrical continuity between said microphone means and said speaker means.

6. The animated action toy of claim 5 wherein said microphone means comprises a carbon microphone and including battery means for supplying electrical potential to said microphone.

7. The animated action toy of claim 6 wherein said switch means and said battery means are mounted in the hollow body of said doll and are connected with said one electrical connector and said speaker means.

8. The animated action toy of claim 1 wherein said pump means includes a variable volume fluid chamber and a lever pivotally mounted on said handle portion for compression and release to vary the volume of said chamber while said handle portion is held in the hand.

9. The animated action toy of claim 1 wherein said fluid chamber means includes a lever pivotally mounted in said body having one end engaged to move said lip and a variable volume fluid chamber engaging said lever remote from said one end to pivot the same upon changes of volume of said fluid chamber initiated by actuation of said pump means in communication therewith.

10. The animated action toy of claim 9 wherein said face includes a flexible outer skin continuous between a pair of lips with an indented mouth defined therebetween and one of said lips relatively movable toward and away from the other, said one end of said lever engaging one of said lips for producing said relative movement.

11. The animated action toy of claim 10 including a finger in said body having an outer end engaging the other of said lips, said lever mounted for pivotal movement relative to said finger.

12. The animated action toy of claim 11 wherein said fluid chamber has one end attached to said finger and an opposite end positioned to engage said lever for rocking movement relative to said finger.

* * * * *